United States Patent [19]

Patton et al.

[11] 4,390,068

[45] Jun. 28, 1983

[54] CARBON DIOXIDE STIMULATED OIL RECOVERY PROCESS

[75] Inventors: John T. Patton, Las Cruces, N. Mex.; Carl M. Canfield, Littleton, Colo.

[73] Assignee: Champlin Petroleum Company, Wilmington, Calif.

[21] Appl. No.: 250,894

[22] Filed: Apr. 3, 1981

[51] Int. Cl.[3] ..... E21B 43/22; E21B 43/40

[52] U.S. Cl. ..... 166/267; 166/305 R

[58] Field of Search ..... 166/263, 266, 267, 268, 166/273, 274, 305 R

[56] References Cited

U.S. PATENT DOCUMENTS

| | | | |
|---|---|---|---|
| 2,729,291 | 5/1956 | Haverfield | 166/263 |
| 3,003,554 | 10/1961 | Craig, Jr. et al. | 166/274 |
| 3,065,790 | 11/1962 | Holm . | |
| 3,075,918 | 1/1963 | Holm . | |
| 3,084,740 | 4/1963 | West et al. | 166/274 X |
| 3,240,271 | 3/1966 | Ortloff | 166/263 |
| 3,252,512 | 5/1966 | Baker et al. | 166/263 |
| 3,262,498 | 7/1966 | Connally, Jr. et al. | 166/273 |
| 3,342,256 | 9/1967 | Bernard et al. | 166/274 X |
| 3,411,583 | 11/1968 | Holm et al. | 166/305 R |
| 3,442,332 | 5/1969 | Keith | 166/266 |
| 3,586,107 | 6/1971 | Parrish | 166/273 |
| 4,224,992 | 9/1980 | Comberiati et al. | 166/274 X |
| 4,250,965 | 2/1981 | Wiseman, Jr. | 166/305 R |

OTHER PUBLICATIONS

Beeson et al., "Laboratory Investigation of the Water--Driven Carbon Dioxide Process for Oil Recovery", Journal of Petroleum Technology, Apr. 1959, pp. 63-66.

Holm, "Carbon Dioxide Solvent Flooding for Increased Oil Recovery", Petroleum Transactions, AIME, vol. 216, 1959, pp. 225-231.

*Primary Examiner*—Stephen J. Novosad
*Assistant Examiner*—George A. Suchfield
*Attorney, Agent, or Firm*—Lyon & Lyon

[57] ABSTRACT

A process of stimulating oil recovery utilizing carbon dioxide in the liquid state is disclosed. The carbon dioxide is introduced into an underground formation where it partially dissolves in the crude oil present therein. A back pressure in the range of atmospheric to approximately 300 psi is maintained on the formation while the oil containing carbon dioxide is withdrawn. The carbon dioxide is thereafter separated from the oil.

18 Claims, No Drawings

CARBON DIOXIDE STIMULATED OIL RECOVERY PROCESS

BACKGROUND OF THE INVENTION

The present invention relates to a process of stimulating oil recovery utilizing carbon dioxide, and more particularly to such a process in which the carbon dioxide is in the liquid state and a back pressure of only a relatively small magnitude, from atmospheric to approximately 300 psi, is maintained on the underground formation during the production cycle.

It is now well known that there are significant reservoirs of low gravity crude oil in underground formations. Because of this, extensive efforts have been undertaken over the years to develop feasible techniques to stimulate the production of oil from such reservoirs. Since the oil which remains in such formations, however, is highly viscous, it is very difficult to recover.

A number of methods have been attempted to stimulate oil recovery from such underground formations including flooding, steam injection and gas injection, but to date none has been totally satisfactory. Thus, in most instances, for example, the viscous oil cannot be displaced efficiently by water or other flooding agents. By the same token, steam injection has certain disadvantages in that it cannot be used successfully in certain types of formations and also requires the availability of inexpensive fuel and a large supply of good water.

A variety of chemical additives have also been evaluated to enhance the flow of viscous oil, but these likewise have significant limitations. Thus, while the viscosity of the oil can be effectively reduced by diluting with appropriate solvents, the solvent must not only be soluble in the oil, but must not break out as an immiscible, mobile phase produced preferentially to the oil, or if it does break out, must then remain trapped as an immobile phase to provide energy to promote stimulated oil flow by expansion. Accordingly, it is difficult to obtain a solvent possessing such necessary characteristics. Additionally, available organic solvents are unable to penetrate sufficiently deeply into the reservoir, and, consequently, only a relatively small incremental gain in oil production is achieved.

It has also been known for a number of years that carbon dioxide is useful in stimulating oil recovery due to its high solution factor in crude oils which causes the viscosity of the crude oil-carbon dioxide solution to be markably lower than that of the crude oil itself. For illustrative examples of stimulation processes utilizing carbon dioxide, reference may be made to U.S. Pat. No. 3,442,332 and to the list of United States Patents and publication identified therein in column 2, lines 24 through 49.

In general, carbon dioxide oil recovery processes are of two types. First, where direct communication between adjacent wells exist or can be established, carbon dioxide may be introduced into the formation by one or more injection wells and the solution of crude oil and carbon dioxide withdrawn through one or more production wells which are different from the injection wells. This second method, which is generally identified as the "huff and puff" method, utilizes the same well for both injection and production purposes and is especially suitable for the recovery of crude oil where communication between adjacent wells has not been established. In this method, carbon dioxide is introduced into the underground formation, and the formation is then closed off to permit the oil to absorb the carbon dioxide. The crude oil with the carbon dioxide absorbed therein will then expand to fill the voids left by the dissolved carbon dioxide and the water displaced by introduction of the carbon dioxide into the formation. Upon releasing the closure on the formation, the expanded carbon dioxide-crude oil solution will flow or can be easily pumped to the surface where it is collected and the carbon dioxide subsequently separated from the crude oil.

SUMMARY OF THE INVENTION

Although the use of carbon dioxide to stimulate oil recovery has been known for a number of years, in view of the recognized present energy shortage, there is an urgent need for increased oil recovery from existing sources. It is accordingly a principal object of the present invention to provide an improved process for stimulating oil recovery utilizing carbon dioxide.

In the oil stimulation recovery process of this invention, carbon dioxide in the liquid state is introduced into an underground formation containing crude oil and permitted to be absorbed by the oil. A back pressure of a relatively small magnitude, from atmospheric to approximately 300 psi, is maintained on the formation while the crude oil with carbon dioxide absorbed therein is withdrawn, and the carbon dioxide is then separated from the oil.

DESCRIPTION OF THE DRAWING

The FIGURE of drawing is a graphic representation of the results of the illustrative examples set forth hereinafter.

DETAILED DESCRIPTION OF THE PREFERRED EMBODIMENT

As indicated above, in the process of the present invention, carbon dioxide in the liquid state is introduced into an underground formation and back pressure ranging from atmospheric to approximately 300 psi is maintained on the formation while the crude oil containing carbon dioxide absorbed therein is withdrawn from the formation. The liquid carbon dioxide is introduced into the underground formation by injection under pressure, which is as high as possible consistent with availability of carbon dioxide and injection equipment, with a pressure of up to approximately 0.7 psi per foot of formation depth being particularly suitable. Introducing the carbon dioxide as a liquid under such pressure has been found to facilitate disollution of carbon dioxide into the oil and also to promote beneficial lowering of oil viscosity.

Additionally, introducing the carbon dioxide in the liquid state enables the carbon dioxide to be introduced into the formation at a much faster rate, e.g., approximately twice the rate of gaseous carbon dioxide, and the liquid is also believed to be more effective in displacing the unwanted water saturation associated with the residual crude oil, thereby contributing to increased oil and decreased water recovery. To maintain carbon dioxide as a liquid, the temperature must be kept below 88° F. and the pressure at approximately 1,100 psi or higher.

It has also been found that the volume of carbon dioxide introduced into the underground formation is important to achieve the necessary lowering of oil viscosity. Thus, the volume of liquid carbon dioxide should be within the range of approximately one-half to twenty tons per foot of formation depth, with from one to eight tons per foot being preferred and from one to two tons being especially preferred.

Contrary to prior practices and descriptions of oil stimulation processes using carbon dioxide, in the present process, the back pressure maintained on the underground formation during the production cycle is of only a relatively small magnitude, ranging from atmospheric to approximately 300 psi, and preferably from atmospheric to approximately 100 psi. The back pressure on the formation may be regulated by venting the annular space between the well bore and the casing to permit carbon dioxide to be withdrawn.

That increased oil recovery can be obtained by utilizing a back pressure of such relatively small magnitude is particularly surprising since the solubility of carbon dioxide in crude oil increases rapidly with pressure which in turn causes greater reduction in viscosity. However, during the injection cycle, some oil is believed to be displaced away from the well bore, which requires resaturation by return oil flow before stimulated oil production can be obtained, and at high back pressures (low withdrawal rates), production consists primarily of gas and small quantities of water leaving the oil deep in the formation until the stimulation cycle is essentially complete.

To achieve the desired absorption of carbon dioxide in the crude oil and expansion within the formation, the formation will be closed off, following introduction of the liquid carbon dioxide, for a period of from approximately one-half to about one hundred days, preferably from about one to three days. By the same token, to achieve greatest incremental increases in oil production, the undeground formation should be subjected to from between three to six cycles of the stimulation process.

The process of the present invention will be better understood by reference to the following specific but illustrative examples.

EXAMPLE I

This well is completed in approximately fifty net feet of $D_1$ and $D_2$ sand with the top at 2510 feet. This well offered a minimal interval to treat and was confined in a narrow fault segment, thereby reducing the likelihood of the $CO_2$ escaping from the well's drainage radius.

Prior to injecting $CO_2$, the well was cleaned out using a scraper brush tool. 2½" EU tubing was installed with the pump shoe at 2578' with a 77' tail piece and gas anchor with bull plug at 2655' and a perforated nipple at 2590'. A 2" pump with a 42'×1¼" stinger was run with ¾" rods.

404 tons of liquid $CO_2$ were injected into the well in approximately 17 hours. Prior to $CO_2$ injection, salt water from the injection system was injected into the well to establish an injection rate and to bring the pumping pressure up to approximately 500 psi so that a liquid system would exist from the formation to the surface and prevent $CO_2$ from flashing to dry ice. The liquid $CO_2$ was pumped through a heat exchanger connected to a 100 H.P. boiler to heat the liquid $CO_2$ to approximately 50° F. to prevent chilling of well tubular goods and to prevent freezing of the formation in the vicinity of the well bore. The last 10 tons of $CO_2$ were vaporized so as to pack the tubular goods with $CO_2$ gas rather than leaving them full of liquid. Injection pressure during the liquid pumping phase was fairly steady at 900 psi at a treatment rate of 2.4 bbl/min. Pressure increased to 1,200 psi with an attendant reduction in pumping rate to 0.3 bbl/min. during the gas injection phase. This equates to a gas injection rate of 1,322 MCF/D at 1,200 psi wellhead pressure.

Following injection, the surface pressure fell rapidly and stabilized at about 950 psi. After 17 hours of shut-in, the well was opened to production from the tubing through a portable well tester. The gas was stacked to the atmosphere and produced liquids flowed to the flowline. The production of small amounts of water, presumably trapped in the tubing during the water injection phase, were frozen by expanding produced $CO_2$ resulting in an ice block being formed in the separator. After approximately 14 hours of controlled blow-down, the well started producing a small quantity of liquid. However, since the ice block made the tester controls inoperable, the liquid dump would not work, and the tester started producing water and $CO_2$ out the stack which froze and quickly plugged. The well was rerouted through a heat exchanger between the choke and the tester and, for the next several days, the produced fluids were heated before entering the test vessel.

Initial attempts to obtain production tests through the automatic well tester (AWT) were unsuccessful because the $CO_2$ foam would not break in the AWT metering system, causing the total production to be registered as water. This problem was later solved by installing a line heater on the flowline to heat the produced fluids to about 160° F. During the AWT problems, and later in the check of the AWT tests, produced fluid samples from the portable well test sampler were taken to the Oil Lab for determination of dry gravity and cut.

The erratic behavoir during the first few weeks of production reflects the difficulty in obtained significant production using the natural gas lift supplied by the injected $CO_2$. It was soon recognized that a back pressure must be maintained on the formation in order to achieve significant stimulated oil rates and, hence, the pump was employed to control the flow of fluids from the reservoir. After steady fluid production was achieved, the casing pressure was gradually reduced to approximately 50 psi to encourage higher liquid flow rates. This technique was successful in increasing oil rate to a maximum of 43 barrels/day in contrast to pre-test production of only 19 barrels/day. Production was sustained at about 35 barrels/day for a period of two and one-half months, accumulating a total incremental oil production of 1,285 barrels, during which the back pressure was maintained between about 50 and 150 psi. During this period, the well produced 12,600 barrels of water less than it would have under pre-test conditions. After approximately 4 months, the well had reverted to pre-test performance. Cumulative $CO_2$ gas production was 2,500 MCF.

EXAMPLE II

The casing was scraped and cleaned out to a depth of 2639' using a Cavins bailer to remove sand and debris which had accumulated. 2½" EU tubing was run with the pump shoe located at 2519' and connected to a 73'×2½" open-ended tail piece to serve as a gas anchor. A 2"×16" D & B pump was run on 182" rods and equipped with a 55'×1¼" stinger.

The well contained 100' of net sand, thus requiring 806 tons of $CO_2$. 796 tons of $CO_2$ were injected down the annulus at 60° F., using a Haliburton pump truck. Ten more tons were heated to 115° F. in order to displace the liquid $CO_2$ from the annulus with $CO_2$ vapor.

During this final stage, the surface pressure increased from 950 psi to 1,150 psi, reflecting largely the loss in fluid head at the bottom of the well as the liquid $CO_2$ was displaced by gas. Gas injection rate at the 1,150 psi wellhead pressure was 3,150 MCF/D.

This well was shut in for a period of 43 days to allow the $CO_2$ and oil to reach equilibrium and prepare the surface facilities for testing. During this period, the casing pressure fell gradually to an equilibrium value of 760 psi. For the first few days, production consisted mainly of gaseous $CO_2$ which had accumulated around the well bore. Oil production then increased significantly from the pre-test rate of 11 barrels/day to a maximum of 35 barrels/day. During this period, the decision was made to bleed the pressure off the casing in order to encourage higher oil rates. Although this pressure reduction had some immediate effect on increasing productivity, the rapid reduction in casing pressure may have abbreviated the stimulated production phase. Subsequently, the casing valve was shut-in and the pressure allowed to build to 150 psi. This pressure build-up did not affect production and the high stimulated rates were not re-established. The well plateaued at a steady state production rate that is slightly greater than the pre-test rates. This indicates that some degree of well bore cleaning or a permanent shift to more water-wet reservoir character has been achieved. Stimulated production averaged 25 barrels/day for a period of two months. An additional 1,982 barrels of oil were produced and 87,243 less barrels than normal of water were produced.

The results of the foregoing examples may be shown graphically in the figure of drawing which is a plot of Incremental Production v. Back Pressure, wherein the production is expressed in barrels/month/foot of reservoir thickness. It will thus be appreciated that incremental production increased as the back pressure was decreased, with especially significant increases being obtained with pressures of approximately 100 psi or less.

The process of this invention may be used with formations where primary production is occurring as well as reservoirs which are being subjected to secondary recovery processes. By the same token, although the process may be used advantageously with any crude oil formations, it is particularly applicable to those reservoirs of low gravity or heavy crude oil, i.e., oils having an API gravity of about 25° or less.

We claim:

1. A process of stimulating oil recovery comprising introducing carbon dioxide in the liquid state into an underground formation containing crude oil, permitting said carbon dioxide to be absorbed by said crude oil, and maintaining a back pressure in the range of from atmospheric to approximately 300 psi on said formation while withdrawing said crude oil containing carbon dioxide absorbed therein.

2. The process of claim 1 in which said absorbed carbon dioxide is separated from said crude oil after withdrawal from said formation.

3. The process of claim 1 in which said carbon dioxide is introduced into said formation at a pressure of up to approximately 0.7 psi per foot of formation depth.

4. The process of claim 1 in which said carbon dioxide is introduced into said formation at a volume ranging between one half ton to twenty tons of carbon dioxide per foot of formation depth.

5. The process of claim 1 in which said back pressure is maintained within the range of from atmospheric to approximately 100 psi.

6. A process of stimulating oil recovery comprising the steps of introducing carbon dioxide in the liquid state into an underground formation containing crude oil, closing off said formation for a period of time of about one half to 100 days to permit said carbon dioxide to be absorbed by said crude oil, maintaining a back pressure in the range of from atmospheric up to approximately 300 psi on said formation while withdrawing crude oil containing carbon dioxide absorbed therein, and thereafter again subjecting said underground formation to the aforesaid steps.

7. The process of claim 6 in which said underground formation is subjected to from three to six cycles of said stimulation process.

8. The process of claim 6 in which said back pressure is maintained between atmospheric and approximately 100 psi.

9. The process of claim 6 in which said carbon dioxide is introduced at a pressure of up to 0.7 psi per foot of formation depth.

10. The process of claim 6 in which said carbon dioxide is introduced into said formation at a volume of from about one half ton to twenty tons of carbon dioxide per foot of formation depth.

11. The process of claim 6 in which said underground formation is closed for a period of approximately one to three days.

12. The process of claim 6 in which said absorbed carbon dioxide is separated from said crude oil after withdrawal from said formation.

13. A method of stimulating oil recovery comprising introducing carbon dioxide in the liquid state into an underground formation containing low gravity crude oil, said carbon dioxide being introduced into said formation at a pressure of up to approximately 0.7 psi per foot of formation depth and at a volume of approximately one half ton to approximately twenty tons per foot of formation depth, closing off said formation for a period of between approximately one half and one hundred days to permit said carbon dioxide to be absorbed by said residual crude oil, and maintaining a back pressure in a range of from atmospheric to approximately 300 psi on said formation while withdrawing residual crude oil containing carbon dioxide absorbed therein.

14. The process of claim 13 in which said carbon dioxide is thereafter separated from said crude oil after withdrawal from said formation.

15. The process of claim 14 in which said back pressure is maintained in the range from atmospheric to approximately 100 psi.

16. The process of claim 15 in which underground formation is closed off for a period from one to three days.

17. The process of claim 16 in which said underground formation is subjected to from three to six cycles of said stimulation process.

18. The process of claim 13 in which said crude oil has an API gravity of 25° or less.

* * * * *